US006270358B1

(12) United States Patent
Nozick

(10) Patent No.: US 6,270,358 B1
(45) Date of Patent: Aug. 7, 2001

(54) LOW-VOLTAGE MALE CONNECTOR

(75) Inventor: Jacques Nozick, Paris (FR)

(73) Assignee: Infra+ , L'Hay les Roses (FR)

( * ) Notice: Subject to any disclaimer, the term of this patent is extended or adjusted under 35 U.S.C. 154(b) by 0 days.

(21) Appl. No.: 09/538,974

(22) Filed: Mar. 31, 2000

(30) Foreign Application Priority Data

Apr. 1, 1999 (FR) ..... 99 04068

(51) Int. Cl.[7] ..... H01R 12/00

(52) U.S. Cl. ..... 439/76.1; 439/676; 439/496; 439/493

(58) Field of Search ..... 439/76.1, 59, 676, 439/941, 418, 499, 67, 493, 495, 496

(56) References Cited

U.S. PATENT DOCUMENTS

| | | | | |
|---|---|---|---|---|
| 4,714,435 | * | 12/1987 | Stipanuk et al. | 439/496 |
| 5,967,801 | * | 10/1999 | Martin et al. | 439/76.1 |
| 6,116,943 | * | 9/2000 | Ferrill et al. | 439/676 |

FOREIGN PATENT DOCUMENTS

| | | |
|---|---|---|
| 669 627 | 8/1995 | (EP) . |
| 709 930 | 5/1996 | (EP) . |
| 899 833 | 3/1999 | (EP) . |
| 901 201 | 3/1999 | (EP) . |
| WO 98/59396 | 12/1998 | (WO) . |

* cited by examiner

*Primary Examiner*—Tho D. Ta
(74) *Attorney, Agent, or Firm*—Sughrue, Mion, Zinn, Macpeak & Seas, PLLC

(57) ABSTRACT

A low-voltage male connector designed to be plugged into a low-voltage female connector having a plurality of flexible pins serving to come into contact with the male connector so as to establish electrical contact between the male connector and the female connector, the male connector being provided with insulation-displacement contacts, each of which serves to receive a respective conductor wire, wherein the electrical connection between the flexible pins of the female connector and the insulation-displacement contacts is established by a printed circuit provided with conductor tracks, each of which connects a respective insulation-displacement contact to a respective pin.

8 Claims, 4 Drawing Sheets

LOW-VOLTAGE MALE CONNECTOR

The present invention relates to a low-voltage male connector designed to be plugged into a low-voltage female connector having a plurality of flexible pins serving to come into contact with the male connector so as to establish electrical contact between the male connector and the female connector. The type of connector particularly concerned by the present invention is often designated by the term "RJ45" that is encountered frequently in the fields of computing, telephony, etc. and that use low-voltage currents.

BACKGROUND OF THE INVENTION

The male connector of the RJ45 type is known to receive a cord made up of four pairs of twisted conductor wires that are fixed to respective insulation-displacement contacts in the RJ45 male connector. For that purpose, the RJ45 male connector is provided with eight insulation-displacement contacts, each of which has a spike onto which a respective conductor wire can be pushed so as to cut through its insulating covering, thereby making contact with the core of the wire.

Originally, the RJ45 male contact was designed to receive cables in the form of ribbons of parallel conductor wires to be pierced by insulation-displacement contacts spaced apart at the same pitch. Later, because of the high levels of crosstalk between the wires, ribbons of parallel wires were replaced with the above-mentioned twisted pairs. However, the use of twisted pairs makes connecting the cables much more difficult because the pairs must be placed manually in the RJ45 connector. Electrical contact between the male connector and the female connector equipped with flexible contact pins can be established directly on the insulation-displacement contacts lined up in the form of a ribbon like the conductor wires, or else on pins which are connected electrically to the insulation-displacement contacts, and which have contact zones suitable for coming into contact with the flexible contact pins of the female connector. When electrical contact is established directly on the insulation-displacement contacts lined up in the form of a ribbon, the pitch of the contacts of the male connector must be identical to the pitch of the contacts of the female connector with standardized gaps (ISO 88 77). If it is desired to use pairs whose wires are larger, an offset is caused between the insulation-displacement contacts and the wires, making it impossible to connect them.

In addition, since the contacts must have a very short pitch, inductive coupling is generated. In terms of crosstalk, it is essential to compensate that inductive coupling by appropriately crossing over the pins of the male connector that make the connection between the insulation-displacement contacts and the flexible pins of the female connector. Therefore, the RJ45 connector, and particularly the pins that make the contact between the insulation-displacement contacts and the pins of the female connector are particularly complicated to design and to assemble, which gives rise to a manufacturing cost that is high.

In the prior art, Document EP-0 899 833 (D1) describes a jack plug made up of two interfittable housings enclosing a blade support on which eight blades are mounted. At one of their ends, the blades form contacts at one of the housings, while at the other end, close to the other housing, they form insulation-displacement contacts (IDCs).

There is no printed circuit in that plug. The electrical connection is established entirely by the blades.

Document EP-0 901 201 (D2) describes a connector in which a printed circuit board is provided with insulation-displacement contacts (IDCs).

That printed circuit is also provided with contact pins on which the electrical contact is made.

In that connector, the circuit serves to provide conductor tracks for reducing crosstalk, but it does not provide electrical contacts.

Furthermore, it should be noted that the connector in Document D1 is a male connector having rigid contacts, while the connector in Document D2 is a female connector having flexible contacts.

OBJECTS AND SUMMARY OF THE INVENTION

An object of the present invention is to mitigate the drawbacks of the above-mentioned prior art by defining a low-voltage male connector that has low inductive coupling, that can accommodate wires of relatively large section, and that is extremely simple to make.

To this end, the present invention provides a low-voltage male connector designed to be plugged into a low-voltage female connector having a plurality of flexible pins serving to come into contact with the male connector so as to establish electrical contact between the male connector and the female connector, said male connector being provided with insulation-displacement contacts, each of which serves to receive a respective conductor wire, the electrical connection between the flexible pins of the female connector and the insulation-displacement contacts being established by a printed circuit provided with conductor tracks, each of which connects a respective insulation-displacement contact to a respective pin. The electrical contact with the flexible pins of the female contact is thus established directly on the printed circuit and not on separate pins, as it is in Document EP-0 901 201. The use of a printed circuit is particularly advantageous because it makes it easy to cross over the conductor tracks which are conventionally formed in an RJ45 connector by crossing over the contact pins of the male connector. In a printed circuit, tracks can be crossed over simply by means of vias causing the tracks to go from one of the conductor planes of the printed circuit to its other conductor plane. In addition, the inductive coupling that is induced because the contacts are very close together is easy to compensate for crosstalk by means of an improved circuit having inductive and capacitive elements for compensating crosstalk. The printed circuit thus offers the advantage of making it easy to cross over the tracks and to provide elements enabling the induced coupling to be compensated.

In addition, the printed circuit may serve as a support for fixing the insulation-displacement contacts. Thus, it is easy to spread out the insulation-displacement contacts over the printed circuit so as to facilitate wiring.

According to a particularly advantageous characteristic of the present invention, the printed circuit is provided with contact zones serving to come into sliding contact with the flexible pins as the male connector is plugged into the female connector, whose flexible pins flex and change angular position, said zones being provided on a rounded or angled portion of the printed circuit. Thus, the printed circuit advantageously serves as a point of electrical contact with the flexible pins of the female connector. It should be noted that the flexible pins of the female connector undergo a change in angular position of about 15° on plugging into the male connector, so as to provide electrical contact by means of the resilient action of the female pins on the contact zones of the male connector. Thus, the point of contact between each of the pins of the female connector and the respective contact zone of the male connector is a sliding contact. In order to prevent the pins from wearing by friction due to repeated connections, it is preferable or even necessary for the points of contact of the female pins with the contact zones of the male connector to be rounded so as to offer a surface quality that reduces abrasion. As a result, during plugging in, the point of contact of the flexible pins of the female connector is displaced over the rounded surface defined by the contact zones of the printed circuit. By providing these rounded contact zones directly on the printed circuit, it is possible to avoid having to provide an additional piece for performing this function.

In a first embodiment, the printed circuit comprises a rigid substrate, said rounded portion being provided on an edge of said substrate, e.g. by forming or stamping. In a variant, the printed circuit comprises a rigid substrate, said angled portion being obtained by folding the substrate over, substantially at one edge thereof. The rigid substrate then performs not only an electrical function but also a mechanical sliding contact function.

In another embodiment, the printed circuit comprises a rigid substrate and a flexible sheet, said rounded or angled portion being obtained by bending said flexible sheet. The flexibility of the sheet is then used to create the rounded portion.

Advantageously, the flexible sheet is provided with an additional track in electrical contact with a ground continuity element serving to come into electrical contact with a ground terminal situated in the female connector.

According to another characteristic, the printed circuit is provided with a guide member at said contact zones, which guide member is advantageously in the form of a comb serving to guide the flexible pins onto said contact zones. And when the male connector includes a metal or metal-plated housing, said guide member is preferably electrically insulating so as to avoid any short-circuiting between the housing of the male connector and the flexible contact pins of the female connector.

BRIEF DESCRIPTION OF THE DRAWINGS

The invention is described more fully below with reference to the accompanying drawings giving embodiments of the present invention by way of non-limiting example.

In the drawings.

MORE DETAILED DESCRIPTION

Figure 1:
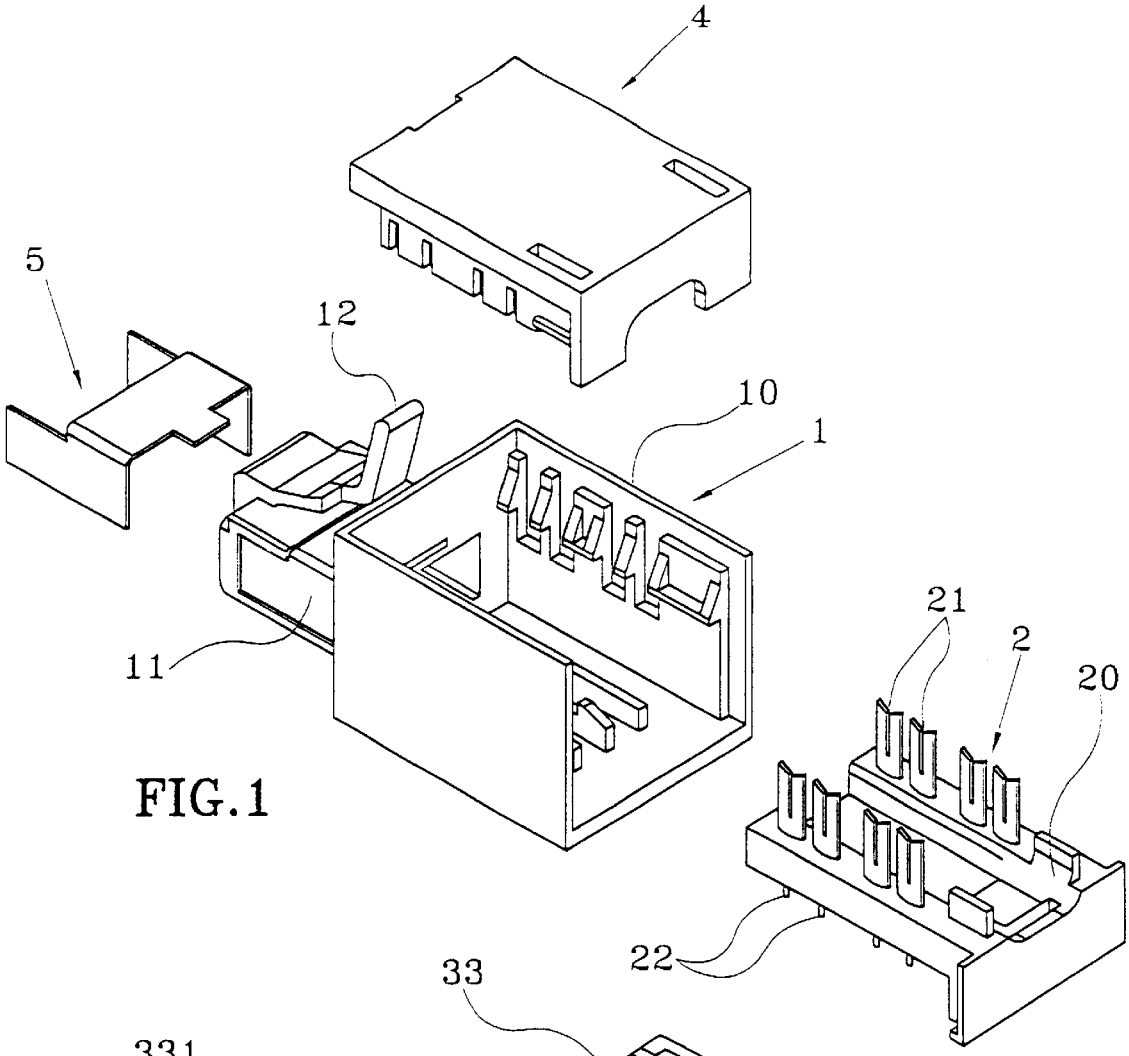
FIG. 1 is an exploded perspective view of a low-voltage male connector of the invention.

The low-voltage male connector that is described below is a connector of the RJ45 type. The particular design of this connector should not be considered to be limiting, but rather numerous variants of it are possible without going beyond the ambit of the invention.

The connectors shown in FIGS. 1, 2, 3, 4, 5, 6, and 7 are substantially identical in general structure. They are made up essentially of five component elements, namely a body 1, an insulation-displacement contact support 2, a printed circuit board 3, an organizer cover 4, and a ground continuity yoke 5.

Figure 3:
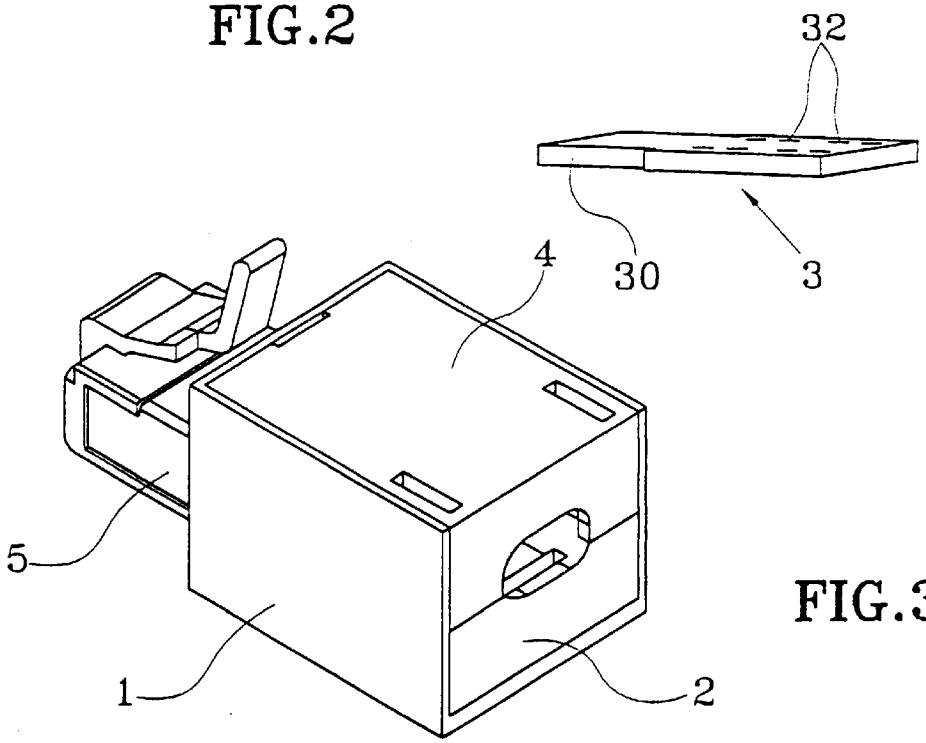
FIG. 3 is a perspective view of a connector of the invention in the assembled state.

The body 1 is, in general, made of a molded plastics material, and it comprises a frame 10 and a plug-in projection 11 designed to be plugged into the corresponding female connector in which it is held by snap-fastening by means of a flexible snap-fastening catch 12. The frame 10 defines an internal space in which the printed circuit board 3 and the insulation-displacement contact support 2 are disposed. The frame 1 is closed by means of an organizer cover 4 whose function is to spread out the conductor wires of the connection cable. In order to make it easier to insert the conductor wires into the respective insulation-displacement contacts 21, the cover is used to hold the conductor wires of the cable in a configuration that enables them to be inserted into the slots of the insulation-displacement contacts 21. Thus, the operator assigned to performing the wiring starts by disposing the wires individually in the organizer cover. In the assembled state, the printed circuit board 3 and the insulation-displacement contact support 2 are already mounted inside the frame 10, and it is then necessary merely to put the cover 4 in place, and to push it in order to cut into the conductor wires in the slots of the insulation-displacement contacts 21. In the assembled state, as shown in FIG. 3, the frame contains the insulation-displacement contact support 2 and a portion of the printed circuit board 3 (namely the wider portion 34), while the narrower portion 35 extends inside the plug-in projection 11.

An advantageous characteristic of the invention lies in the fact that a printed circuit board 3 is used to form the electrical links between the insulation-displacement contacts 21 and the flexible contact pins (shown diagrammatically at 6) of the female connector. As in conventional RJ45 connector, the contact zones 331 of the male connector that are designed to come into electrical contact with the flexible pins 6 of the female connector are situated at the bottom end of the plug-in projection 11, as shown in FIGS. 1 and 2. These contact zones 331 (FIG. 1*a*)

Whereas, in the prior art, pins are used to establish the electrical links between the insulation-displacement contacts 21 and the flexible pins 6 of said female connector, in the invention, a printed circuit board 3 is used to establish said electrical links. For this purpose, the printed circuit 3 is provided with a plurality of (generally eight) conductor tracks 335, each of which connects a respective insulation-displacement contact 21 to a respective flexible pin 6 of the female connector. As can be seen clearly in FIG. 1, the printed circuit board 3 which, in this example, is in the form of a rigid substrate 30, is provided with connection holes 32 for receiving contact studs 22 advantageously made integrally with the insulation-displacement contacts 21. In practice, the insulation-displacement contact support 2 comprises a molded plastics structure 20 through which the insulation-displacement contacts 21 extend, which contacts are terminated by the contact studs 22 which project from the opposite face of the structure 20 so that they can be inserted into the connection holes 32 provided in the printed circuit board 3. Thus, electrical contact is made simply between the insulation-displacement contacts 21 and the printed circuit board 3. In addition, because of the relatively large surface area of the printed circuit board 3, it is easier to spread out the insulation-displacement contacts 21 in a manner such as to facilitate wiring by means of the organizer cover 4.

Figure 1A:
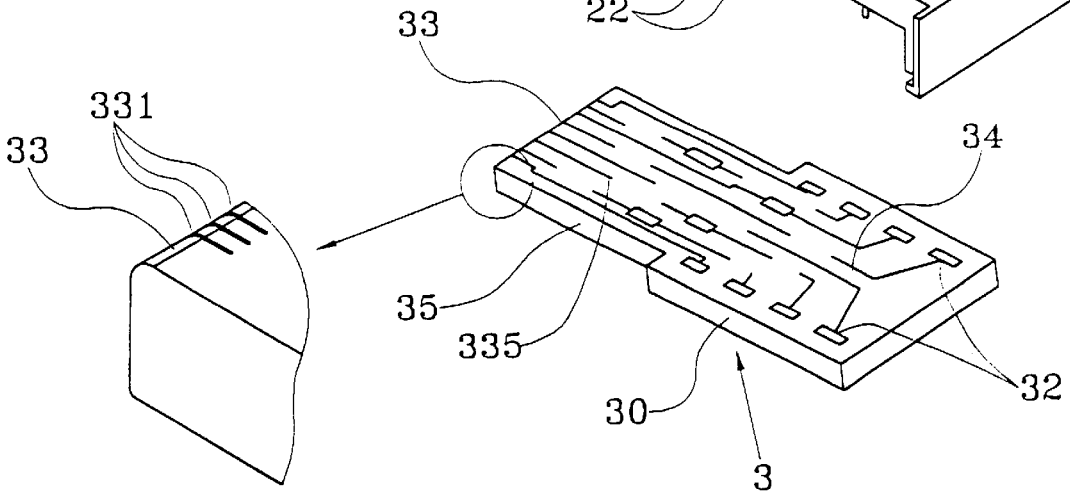
FIG. 1*a* is an enlarged view of a detail of FIG. 1.
Figure 2:
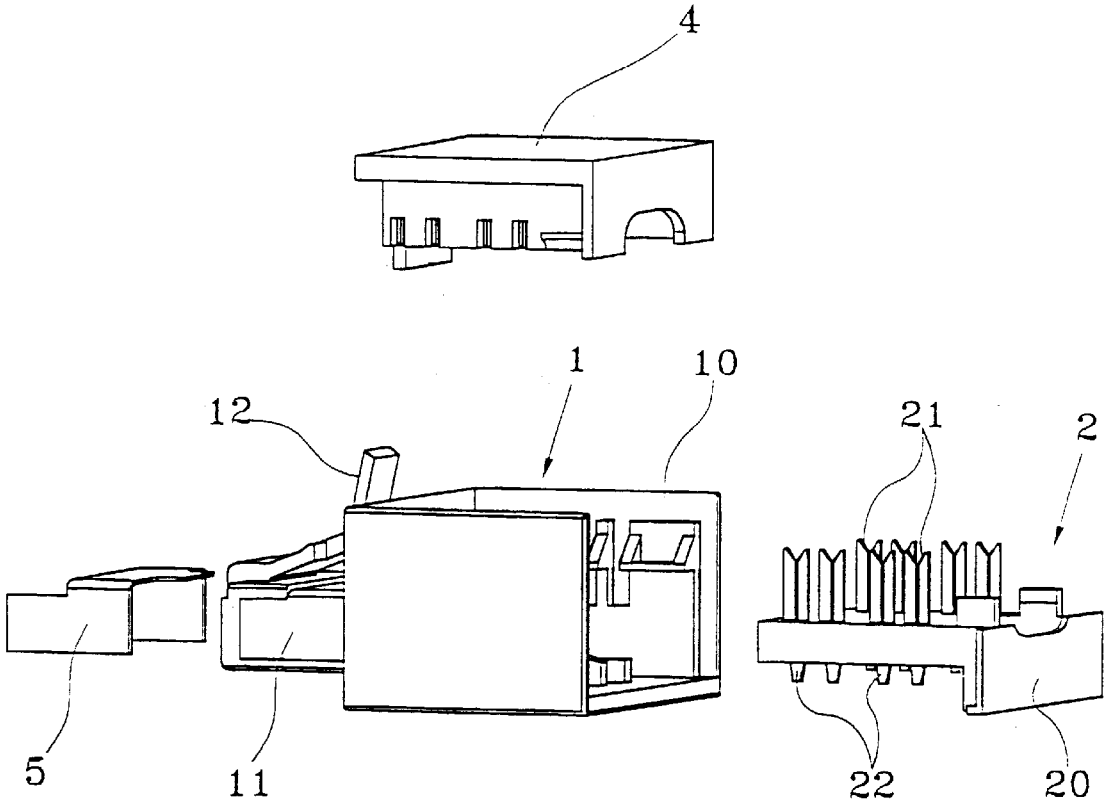
FIG. 2 is another exploded perspective view of the connector of FIG. 1.
Figure 4:
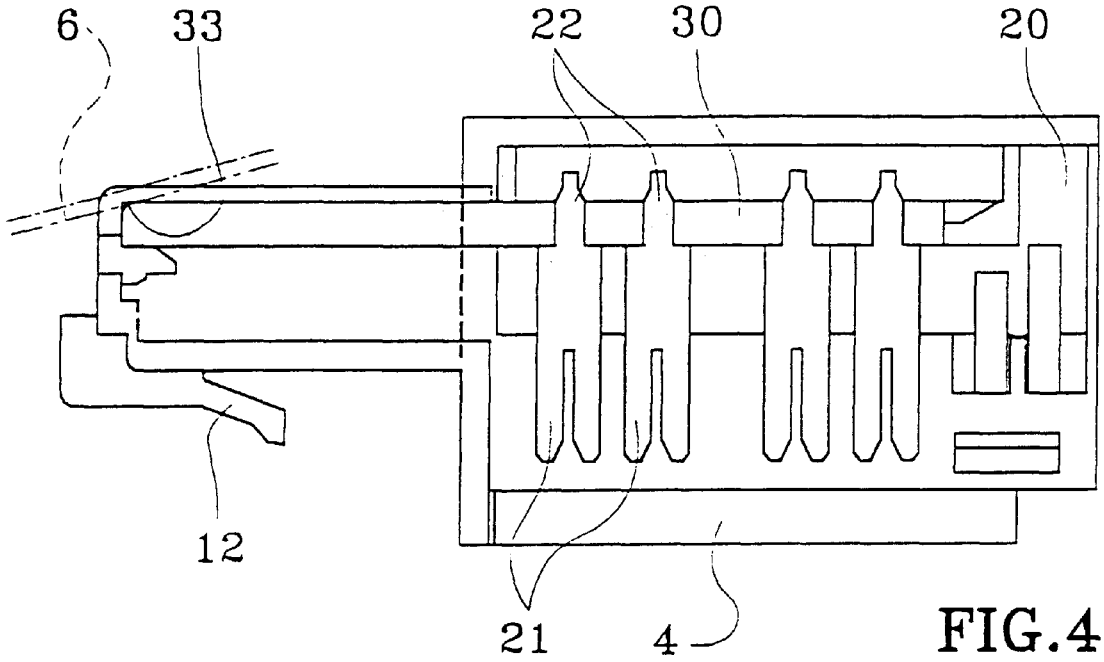
FIG. 4 is a view in cross-section through the connector shown in FIGS. 1 to 3.

According to another particularly advantageous characteristic of the invention, the edge 33 of the printed circuit board 3 is rounded, as can be seen more clearly in FIG. 1*a* and in FIG. 4. It is in this rounded portion of the printed circuit board 3 that the contact zones 331 serving to come into contact with the flexible pins 6 of the female connector are situated. As described above, on plugging in the male connector, the flexible pins of the female connector undergo flexing which changes their angular positions and thus their points of contact with the contact zones of the male connector. By providing the contact zones on the rounded portion, the flexible pins of the female connector can slide almost without friction over the contact zones, thereby retarding connector wear.

The use of a printed circuit board 3 for making the electrical links between the insulation-displacement contacts 21 and the flexible pins 6 of the female connector offers several advantages: firstly, it is easy to establish electrical contact between the insulation-displacement contacts 21 and the printed circuit board 3 because of its large area. Secondly, it is easy to form conductor tracks in the printed circuit 3 that satisfy crosstalk requirements by providing capacitive and inductive elements in the printed circuit and by using vias for crossing over conductor tracks. Thirdly, by means of its rounded profile at its edge 33, the printed circuit board can be used directly to form contact zones that fully satisfy the requirements related to changes in the angular positioning of the flexible pins of the female connector on plugging in the male connector.

In the embodiment shown in FIGS. 1, 2, and 4, the contact zones 331 are provided in a rounded portion of the edge 33 of the printed circuit board. The rounding can be performed by any technique, such as forming or stamping.

Figure 5:
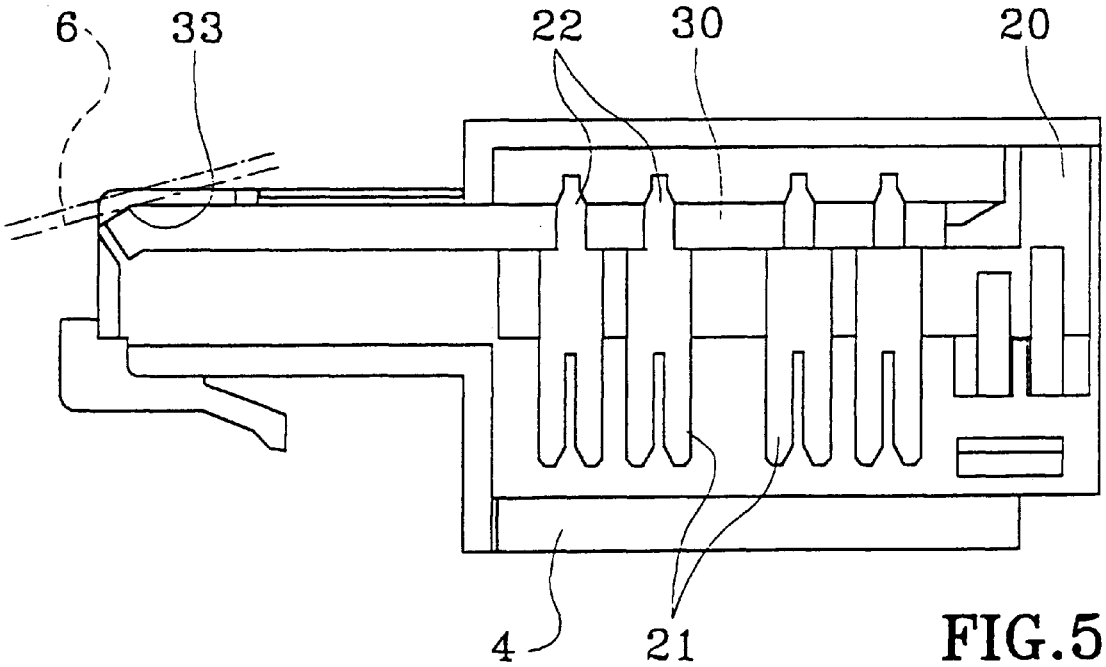
FIG. 5 is a view in cross-section through a second embodiment of a connector of the invention.

The male connector shown in FIG. 5 differs from the male connector shown in FIG. 4 in that the contact zones 331 are situated on a curved or angled portion of the printed circuit 3. This embodiment is entirely equivalent to the embodiment shown in FIG. 4 in that the edge of the printed circuit 3 forms a contact surface that enables the flexible pins 6 to remain continuously in contact while they are changing angular position.

Figure 6:
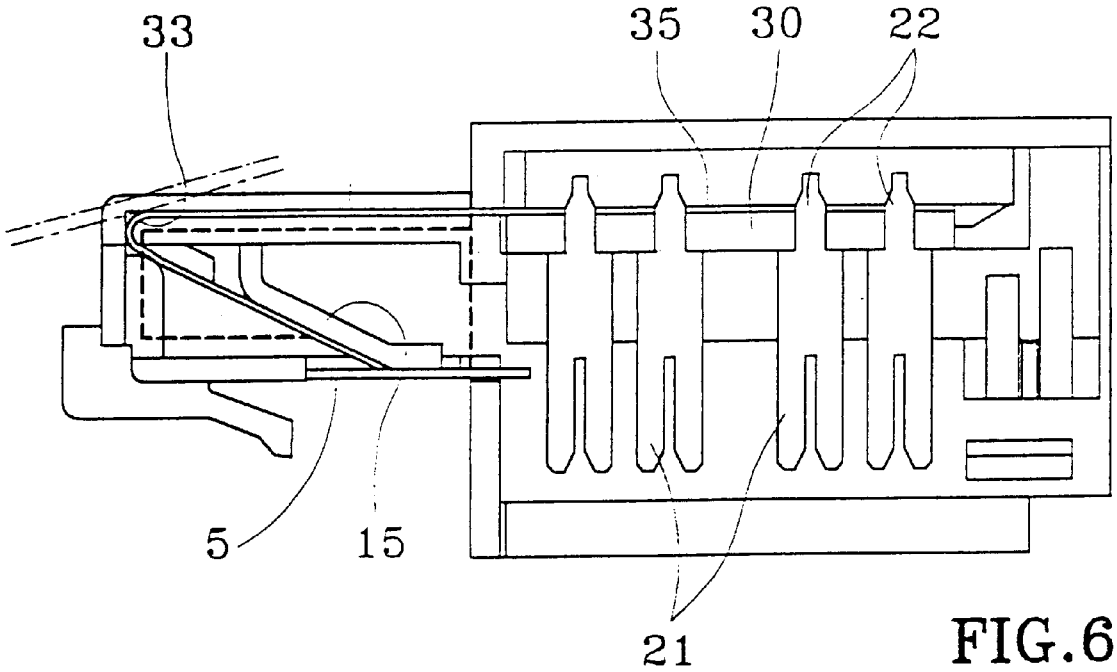
FIG. 6 is a view in cross-section through a third embodiment of a connector of the invention.

FIG. 6 shows a third embodiment of the printed circuit 3. In this case, the printed circuit is not merely constituted by a rigid substrate as it is in the embodiments shown in FIGS. 4 and 5, but rather it is supplemented by a flexible thin sheet 35 which, together with the substrate 30, forms the printed circuit board. The rigid substrate 30 is fully contained inside the frame 10 of the body 1 whereas the flexible sheet 35 extends from the frame 10 into the plug-in projection 11. In this example, the contact zones 331 are defined at a bend 33 in the flexible sheet 35, which bend is formed by folding the sheet back on itself. The flexibility of the sheet 35 is used to form the rounded portion defining the contact zones. In addition, the sheet 35 extends beyond the bend 33 so as to come into contact with the ground continuity cage 5 which is also shown in FIGS. 1 and 2. To hold the sheet in contact with the ground continuity cage, the plug-in projection 11 is provided with a resilient tab which presses the sheet 35 against a wall of the ground continuity cage 5. To establish the electrical links, the flexible sheet 3 is provided with an additional track whose contact zone extends to that portion of the sheet which is clamped between the tab 15 and the cage 5. Once it is plugged into the female connector, the cage 5 provides electrical contact with a pin of the female connector so as to provide ground continuity.

Figure 7:
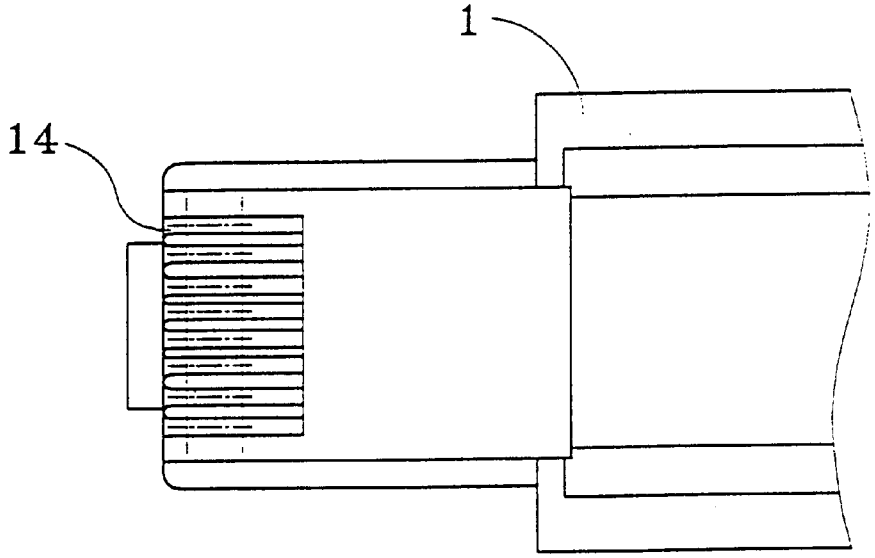
FIG. 7 is a plan view of the connector of FIG. 6.

FIG. 7 is a plan view of the connector of FIG. 6. It can be seen that the plug-in projection 11 is provided with a piece which forms a guide comb 14 that separates the contact zones and that makes it possible to guide the flexible pins 6 of the female connector onto the contact zones 331 of the printed circuit board 3. When the body 1, and optionally the organizer cover 4 are made of metal or of a metal-plated plastic, it is advantageous and even necessary to make the comb 14 of non-plated plastic in order to avoid any short-circuiting between the body 1 and the female connector during plugging in.

What is claimed is:

1. A low-voltage male connector designed to be plugged into a low-voltage female connector having a plurality of flexible pins serving to come into contact with the male connector so as to establish electrical contact between the male connector and the female connector, said male connector being provided with insulation-displacement contacts, each of which serves to receive a respective conductor wire, wherein the electrical connection between the flexible pins of the female connector and the insulation-displacement contacts is established by a printed circuit board provided with conductor tracks, each of which connects a respective insulation-displacement contact to a respective flexible pin, wherein the conductor tracks are provided with contact zones serving to come into sliding contact with the flexible pins as the male connector is plugged into the female connector, during which the flexible pins flex and change angular position, the contact zones being provided on one of a rounded portion and an angled portion of the printed circuit board.

2. A male connector according to claim 1, in which the printed circuit board comprises a rigid substrate, the rounded portion being provided on an edge of the substrate.

3. A male connector according to claim 1, in which the printed circuit board comprises a rigid substrate and a flexible sheet, the angled portion being obtained by folding the flexible sheet over substantially at one edge thereof.

4. A male connector according to claim 1, in which the insulation-displacement contacts are fixed to the printed circuit board.

5. A male connector according to claim 1, in which the printed circuit board comprises a rigid substrate and a flexible sheet, said rounded or angled portion being obtained by bending said flexible sheet.

6. A male connector according to claim 5, in which the flexible sheet is provided with an additional track in electrical contact with a ground continuity element serving to come into electrical contact with a ground terminal situated in the female connector.

7. A male connector according to claim 1, in which the printed circuit board is provided with a guide member at the contact zones, the guide member is in the form of a comb serving to guide the flexible pins onto the contact zones.

8. A male connector according to claim 7, including one of a metal housing and a metal-plated housing, the guide member being electrically insulating.

* * * * *